US010674773B2

(12) United States Patent
McGaughy et al.

(10) Patent No.: US 10,674,773 B2
(45) Date of Patent: Jun. 9, 2020

(54) UTILITY BRA SYSTEMS, AND METHODS OF USE AND MANUFACTURE

(71) Applicants: Susan McGaughy, Pismo Beach, CA (US); Heidi Parker, Pismo Beach, CA (US); Mindy L. Schembari, Hagatna, GU (US)

(72) Inventors: Susan McGaughy, Pismo Beach, CA (US); Heidi Parker, Pismo Beach, CA (US); Mindy L. Schembari, Hagatna, GU (US)

(73) Assignee: The Closet & Etc., Arroyo Grande, CA (US)

( * ) Notice: Subject to any disclaimer, the term of this patent is extended or adjusted under 35 U.S.C. 154(b) by 210 days.

(21) Appl. No.: 15/836,562

(22) Filed: Dec. 8, 2017

(65) Prior Publication Data

US 2019/0174839 A1 Jun. 13, 2019

(51) Int. Cl.

| | |
|---|---|
| ***A41C 3/00*** | (2006.01) |
| ***A41C 3/12*** | (2006.01) |
| *A41D 27/20* | (2006.01) |

(52) U.S. Cl.

CPC ..... *A41C 3/005* (2013.01); *A41C 3/0035* (2013.01); *A41C 3/12* (2013.01); *A41D 27/205* (2013.01)

(58) Field of Classification Search

CPC .. A41C 3/06; A41C 3/005; A41C 3/12; A41F 15/00

USPC ..... 450/86, 89

See application file for complete search history.

(56) References Cited

U.S. PATENT DOCUMENTS

| | | | | |
|---|---|---|---|---|
| 2,492,862 | A | 12/1949 | Harvey | |
| 2,764,759 | A | 10/1956 | Gazelle | |
| 4,815,510 | A | 3/1989 | Edelist | |
| 5,155,869 | A | 10/1992 | Ralli et al. | |
| 5,445,858 | A * | 8/1995 | Nwoko | A45F 3/12 428/174 |
| 5,496,205 | A | 3/1996 | Lee | |
| 5,653,336 | A | 8/1997 | Buonaiuto et al. | |
| 5,711,469 | A | 1/1998 | Gormley et al. | |
| 6,146,239 | A | 11/2000 | Magliocchetti | |
| 6,318,613 | B1 | 11/2001 | Underhill | |

(Continued)

OTHER PUBLICATIONS

Koala Clip Product Homepage, 7 pages. Retrieved from https://images.app.goo.gl/GHU1LGwXp3vuaFdA8 Accessed on Feb. 19, 2020.

(Continued)

*Primary Examiner* — Gloria M Hale

(74) *Attorney, Agent, or Firm* — Kilpatrick Townsend & Stockton LLP

(57) ABSTRACT

A utility bra includes a right strap, a left strap, a right cup coupled with the right strap, a left cup coupled with the left strap, a center panel coupled with the right cup and the left cup, and a strap securing mechanism having an inner securing layer and an outer securing layer. The inner securing layer includes an inner gripping element and the outer securing layer includes an outer gripping element. The inner gripping element and the outer gripping element face toward one another, for example when the utility bra is worn by a user. The strap securing mechanism is coupled with the right strap or the left strap. The inner gripping element and the outer gripping element operate to grip the a personal item between the inner securing layer and the outer securing layer.

6 Claims, 14 Drawing Sheets

(56) References Cited

U.S. PATENT DOCUMENTS

| | | | | |
|---|---|---|---|---|
| 7,364,491 | B2 | 4/2008 | Updyke | |
| 7,585,200 | B1 | 9/2009 | McLaren | |
| 7,753,759 | B2 | 7/2010 | Pintor et al. | |
| 8,257,140 | B2 | 9/2012 | Kenny | |
| 8,597,071 | B2 | 12/2013 | Shweky et al. | |
| 8,597,072 | B1 * | 12/2013 | Lucas | A41C 3/0035 2/247 |
| 8,771,036 | B2 | 7/2014 | Gentry et al. | |
| 9,060,550 | B2 | 6/2015 | Conrad | |
| 9,295,288 | B1 * | 3/2016 | Goff | A41C 3/0035 |
| 9,723,878 | B1 | 8/2017 | Goff | |
| 2005/0020184 | A1 * | 1/2005 | Izcoa | A41C 3/12 450/86 |
| 2005/0097658 | A1 * | 5/2005 | Lyons | A41F 15/007 2/267 |
| 2008/0078013 | A1 * | 4/2008 | Koidl-Breitenherdt | A41C 3/12 2/338 |
| 2009/0209173 | A1 * | 8/2009 | Arledge | A41C 3/0035 450/39 |
| 2011/0269376 | A1 * | 11/2011 | Clim | A41F 15/00 450/86 |
| 2016/0037832 | A1 * | 2/2016 | Kogon | A41C 3/06 450/86 |
| 2016/0050995 | A1 * | 2/2016 | Bentley | A41D 27/201 2/114 |
| 2017/0027311 | A1 | 2/2017 | DeDonatis | |
| 2017/0273365 | A1 * | 9/2017 | Muhlenfeld | A41B 1/08 |

OTHER PUBLICATIONS

Google Search Results "all bras [that] hold phones", 3 pages. Retrieved from https://www.google.com/search?q=all%20bras%20the%20hold%20%20phones&tbm=isch Accessed on Feb. 19, 2020.

Google Search Results "vai Athletica", 3 pages. Retrieved from https://www.google.com/search?q=vai%20%20Athletica%20&tbm=isch Accessed on Feb. 19, 2020.

Fabletics Product Homepage, 4 pages. Retrieved from https://images.app.goo.gl/ryKhKV1J7gev7PRE7 Accessed on Feb. 19, 2020.

Google Search Results "Sports bra [that] holds the phone on your shoulder with a strap", 6 pages. Retrieved from https://www.google.com/search?q=Sports%20bra%20the%20holds%20the%20phone%20on%20your%20shoulder%20with%20a%20strap&tbm=isch Accessed on Feb. 19, 2020.

Google Image Search Results "9 Sports Bras to Hold Your Phone—theFashionSpot", 3 pages. Retrieved from https://images.app.goo.gl/nXgTaqqPUhn9kZG57 Accessed on Feb. 19, 2020.

Google Image Search Results "Sports Bras—Best Sports Bras With Pockets", 3 pages. Retrieved from https://images.app.goo.gl/JbAwjZvGUa5W8Gzs6 Accessed on Feb. 19, 2020.

Pinterest Page "Cross Training Archives—The Cookie ChRUNicles", 10 pages. Retrieved from https://www.pinterest.com/pin/288934132323160201/ Accessed on Feb. 19, 2020.

Oiselle Product Homepage, Flyout Bra, 13 pages. Retrieved from https://www.oiselle.com/shop/flyout-bra?gclid=Cj0KCQiAuefvBRDXAIsAFEOQ9HpF6wgHqcYo0yG5FsoCdj5gt9ZJx0g121_cnaaTQPKDfKHv16hSIMaArMzEALw_wcB Accessed on Feb. 19, 2020.

Runner's World Product Homepage "9 of the best sports bras with a pocket for your phone, keys and lipbalm", 15 pages. Retreived from https://www.runnersworld.com/uk/gear/clothes/a776398/best-sports-bras-with-pockets/ Accessed on Feb. 19, 2020.

Carreon, Justine, "5 Sports Bras That Can Actually Hold Your iPhone" ELLE Homepage, Mar. 28, 2016, 7 pages, Retrieved from https://www.elle.com/fashion/shopping/g28059/sports-bras-cell-phone-iphone-pocket/ Accessed on Feb. 19, 2020.

The Fashion Spot Product page, "9 Sports Bras to Hold Your Phone", 3 pages. Retrieved from https://images.app.goo.gl/GhvwqZqc7372XCsaA Accessed on Feb. 19, 2020.

Inspire Uplift Homepage, Hands Free Pocket Bra, 7 pages. Retrieved from https://www.inspireuplift.com/products/hands-free-pocket-bra?variant=43106368225398&cmp_id=1593623679&adg_id=63053331787&kwd=&device=t&gclid=Cj0KCQiAuefvBRDXARIsAFEOQ9E-G1g1c5fwODT7MO88iwGozGCnawGD9bAXgwdmIS_IMW1cbfYAPAlaAp2KEALw_wcB Accessed on Feb. 19, 2020.

* cited by examiner

UTILITY BRA SYSTEMS, AND METHODS OF USE AND MANUFACTURE

BACKGROUND OF THE INVENTION

Embodiments of the present invention encompass garments for holding personal items, and in particular to brassieres for holding cell phones, keys, credit cards, and the like.

BRIEF SUMMARY OF THE INVENTION

A variety of garment designs have been proposed for helping women to carry personal items. However, the need still remains for improved garment designs, and in particular improved bra designs, that allow women to carry or hold personal items in a convenient, comfortable, easily accessible, and fashionable manner. Embodiments of the present invention provide solutions for at least some of these outstanding needs.

In a first aspect, embodiments of the present invention encompass utility bras for holding personal items such as cell phone. An exemplary utility bra can include a right strap, a left strap, a right cup coupled with the right strap, a left cup coupled with the left strap, a center panel coupled with the right cup and the left cup, and a strap securing mechanism having an inner securing layer and an outer securing layer, where the inner securing layer includes an inner gripping element and the outer securing layer includes an outer gripping element. The inner gripping element and the outer gripping element can face toward one another, for example when the utility bra is worn by a user. In some cases, the strap securing mechanism is coupled with the right strap or the left strap. In some cases, the inner gripping element and the outer gripping element operate to grip the a personal item between the inner securing layer and the outer securing layer. In some cases, the inner gripping element includes a non-slip material. In some cases, the inner gripping element includes a material such as a rubber, a thermoplastic, a silicone, a polyurethane, or any combination thereof. In some cases, the strap securing mechanism is a first strap securing mechanism, and the utility bra includes a second strap securing mechanism. In some cases, the second strap securing mechanism can include an inner securing layer and an outer securing layer. In some cases, the inner securing layer of the second strap securing mechanism includes an inner gripping element and the outer securing layer includes an outer gripping element. In some cases, the inner gripping element and the outer gripping element face toward one another, for example when the utility bra is worn by a user. In some cases, the inner gripping element and the outer gripping element are configured to grip a personal item between the inner securing layer and the outer securing layer. In some cases, the strap securing mechanism is coupled with the right strap. In some cases, the strap securing mechanism is coupled with the left strap.

In another aspects, embodiments of the present invention encompass utility bras that include a right strap, a left strap, a right cup coupled with the right strap, a left cup coupled with the left strap, a right wing coupled with the right cup, a left wing coupled with the left cup, a center panel coupled with the right cup and the left cup, and a pocket having an inner liner, an intermediate liner, and an outer liner. In some cases, the pocket is coupled with the right wing or the left wing. In some cases, the pocket is coupled with the right strap. In some cases, the pocket is coupled with the left strap.

BRIEF DESCRIPTION OF THE DRAWINGS

A better understanding of the features and advantages of the present invention will be obtained by reference to the attached documents that set forth illustrative embodiments, in which the principles of the invention are utilized, and the accompanying drawings of which.

DETAILED DESCRIPTION OF THE INVENTION

Figure 1:
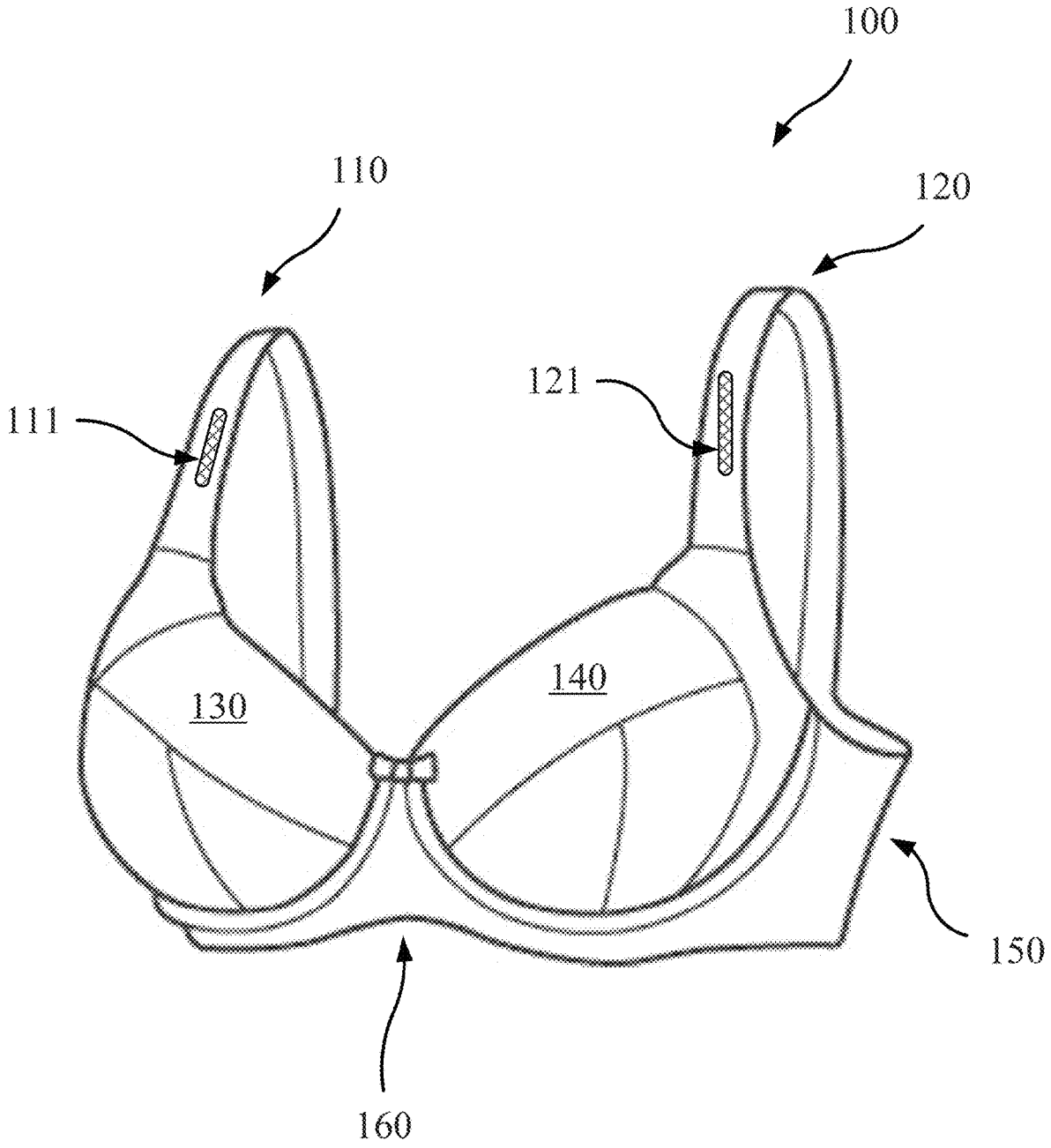
FIG. 1 depicts aspects of a utility bra, according to embodiments of the present invention.

Embodiments of the present invention encompass bras that can be used to hold personal items. One or both bra straps and/or wings can be configured with certain features that can hold various items. For example, a bra strap can be made of (or can include) two ribbons of material, and each ribbon/strap can have one or more gripping rubber strips that face one another. Items such as cell phones can be held within the rubber strips. Turning now to the drawings, FIG. 1 depicts aspects of an exemplary bra 100. As illustrated here, bra 100 includes a right strap 110, a left strap 120, a right cup 130, a left cup 140, a right wing (not shown), a left wing 150, and a center panel 160. The right strap 110 includes a right strap securing mechanism 111 and the left strap 120 includes a left strap securing mechanism 121.

Figure 2A:
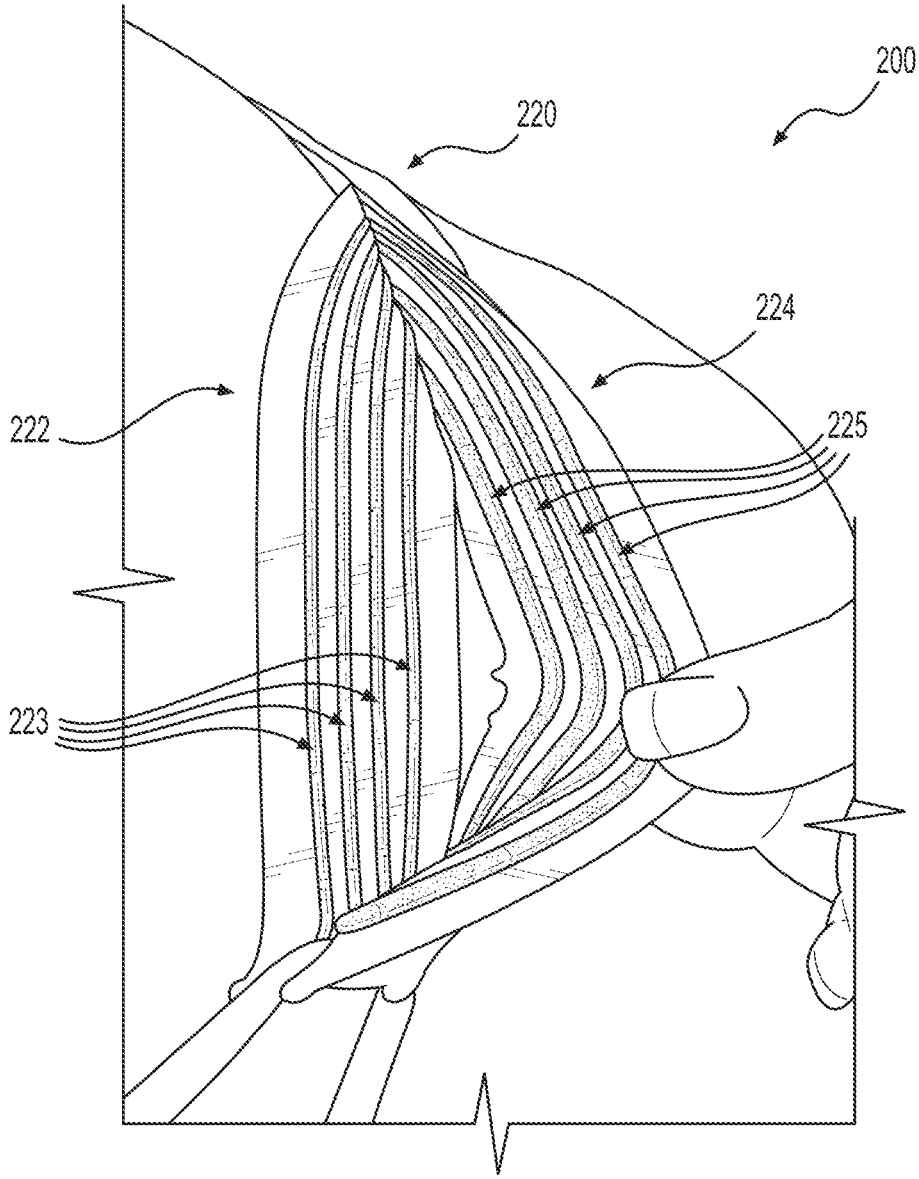
FIGS. 2A and 2B depict aspects of a utility bra, according to embodiments of the present invention.
Figure 2B:
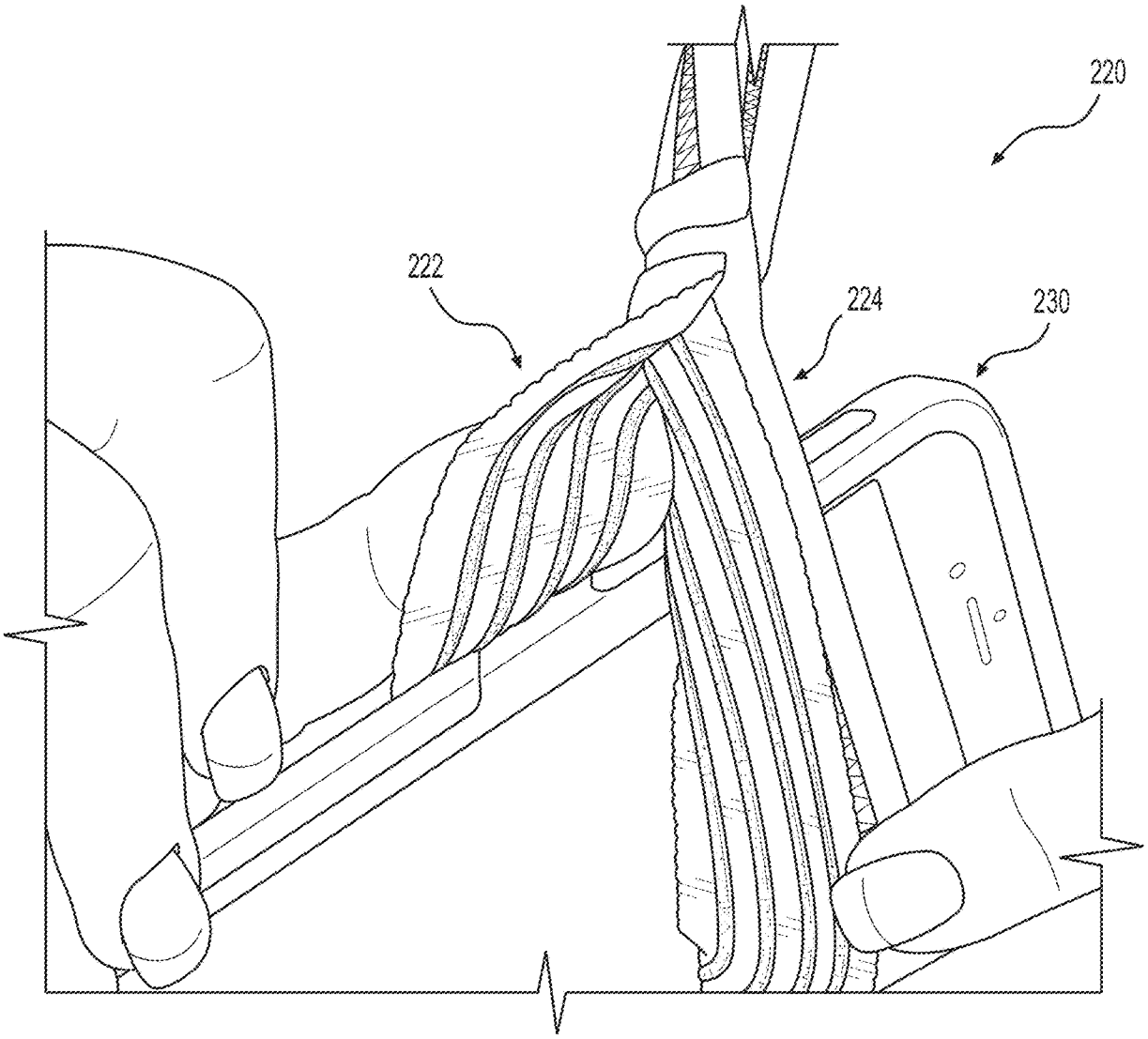

FIG. 2A provides a partial image of a bra 200 according to embodiments of the present invention. As shown here, bra 200 includes a left strap 220 having an inner securing layer 222 and an outer securing layer 224, which in combination form left strap securing mechanism 221. The securing layers 222, 224 can be separated or pulled apart, so as to receive and secure a personal item such as a cell phone 230, as depicted in FIG. 2B. Inner securing layer 222 has one or more inner gripping elements 223 and outer securing layer 224 has one or more outer gripping elements 225. Gripping elements can include or be constructed of rubber, thermoplastic, silicone, polyurethane, or other non-slip materials.

The inner gripping elements 223 and the outer gripping elements 225 face toward one another, and operate to grip the cell phone 230 (or any other desired personal item) between the inner securing layer 222 and the outer securing layer 224. A right strap (not shown) of a bra can have similar features.

Figure 3:
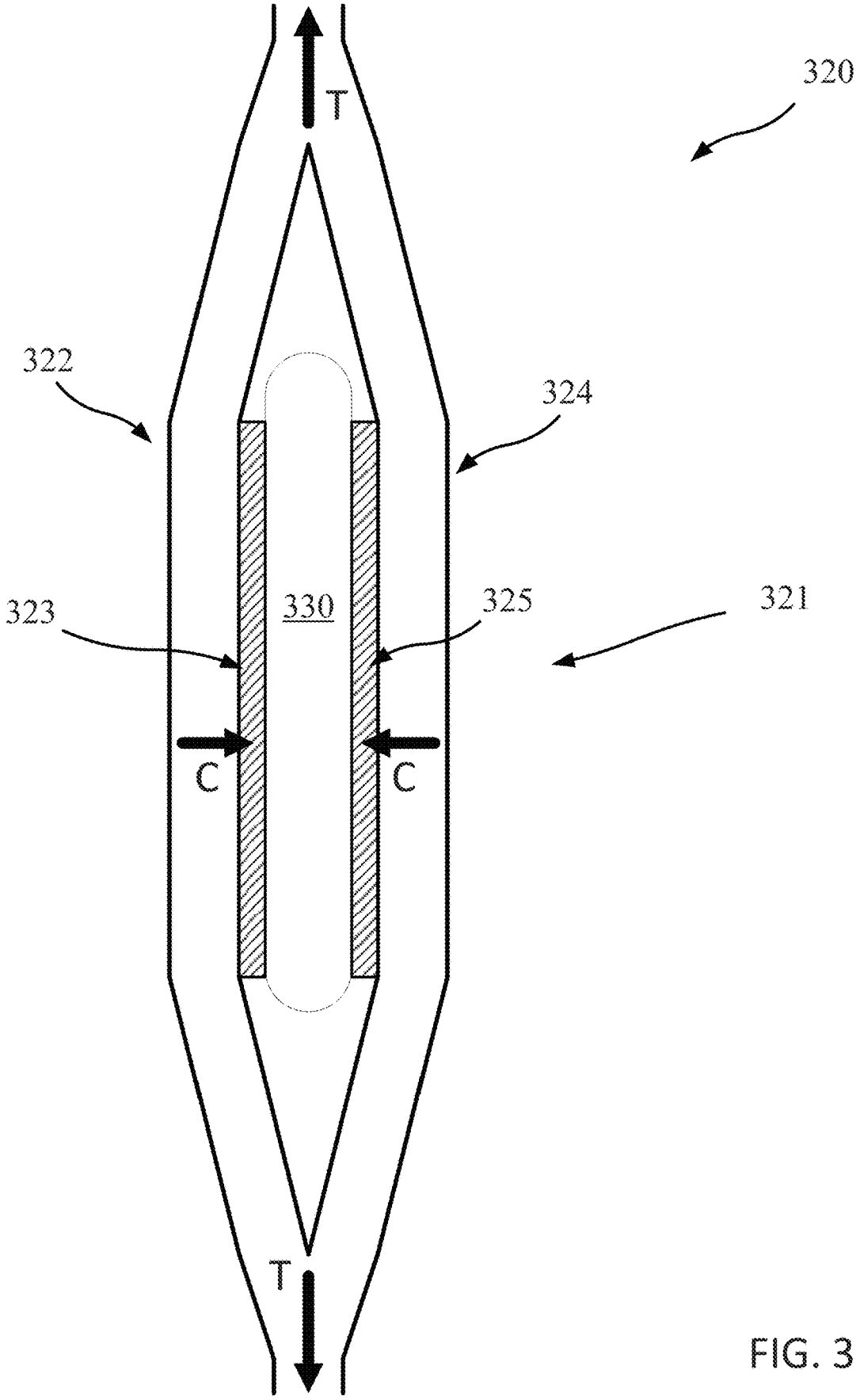
FIG. 3 depicts aspects of a bra strap, according to embodiments of the present invention.

FIG. 3 provides a profile view of a left bra strap 320 according to embodiments of the present invention. Strap 320 includes an inner securing layer 322 and an outer securing layer 324, which in combination form left strap securing mechanism 321. The securing layers 322, 324 can be separated or pulled apart, so as to receive and secure a personal item such as a cell phone 330. Inner securing layer 322 has one or more inner gripping elements 323 and outer securing layer 224 has one or more outer gripping elements 225. The inner gripping elements 323 and the outer gripping elements 325 face toward one another, and operate to grip the cell phone 330 (or any other desired personal item) between the inner securing layer 322 and the outer securing layer 324. Without being bound by any particular theory, it is believed that when the user is wearing the bra, tension forces (as represented by arrows T) that are present in bra strap 320 can operate to transmit or produce compressive forces (as represented by arrows C) between the inner securing layer 322 and outer securing layer 324, press gripping elements 323, 325 against opposing sides of the cell phone 330. A right strap (not shown) of a bra can have similar features.

Hence, a bra strap can be made of (or can include) two ribbons of material, and each ribbon/strap can have one or more gripping rubber strips or elements that face one another. Items such as cell phones can be held within the rubber strips. Stitching lines can be applied across the straps, (e.g. wider spacing between stitching lines or holding large phones, narrower spacing between stitching lines for holding smaller phones).

Figure 4A:
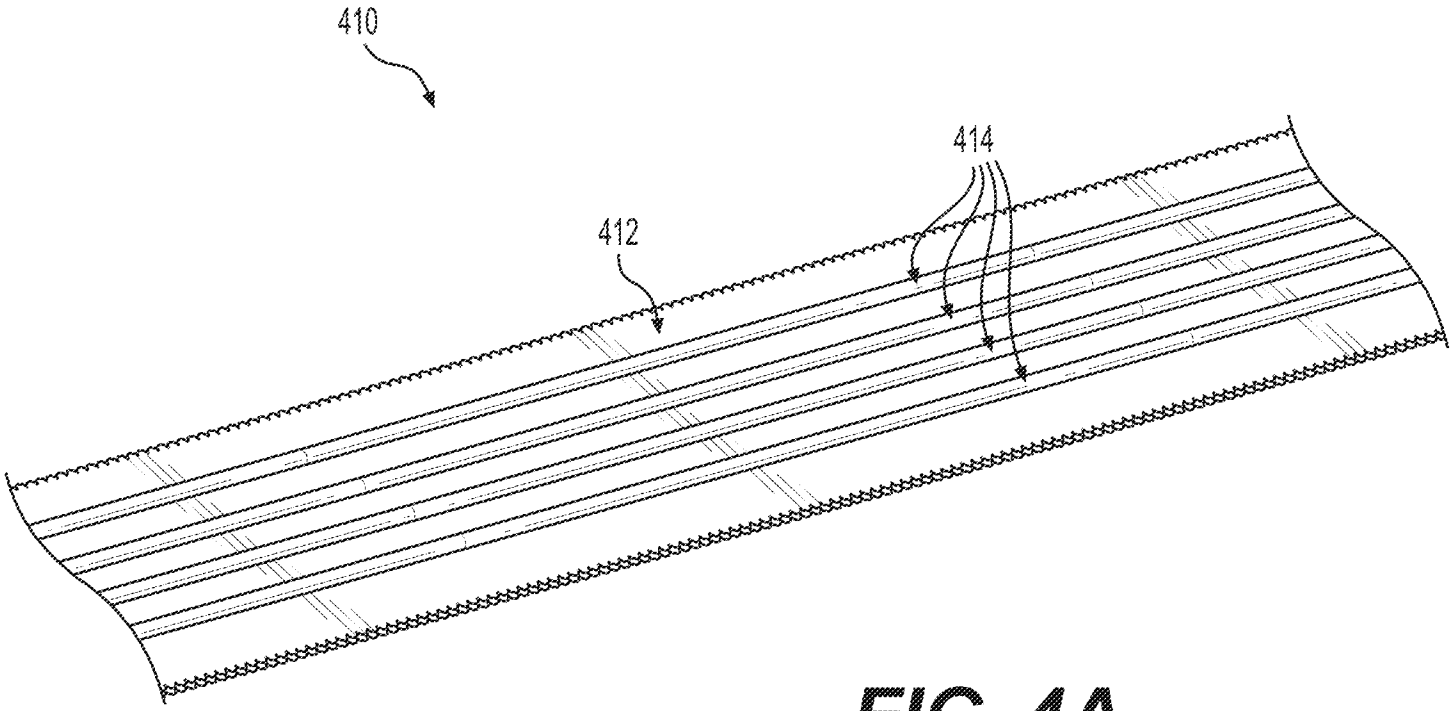
FIG. 4A depicts aspects of a securing layer, according to embodiments of the present invention.

FIG. 4A shows a securing layer 410 according to embodiments of the present invention. As depicted here, securing layer 410 includes a backing 412 and one or more gripping elements 414. The backing 412 can be an elastic band. In the illustrated embodiment, there are four elongate linear gripping elements. In some cases, gripping elements 414 extend or project from the surface of the backing 412.

Figure 4B:
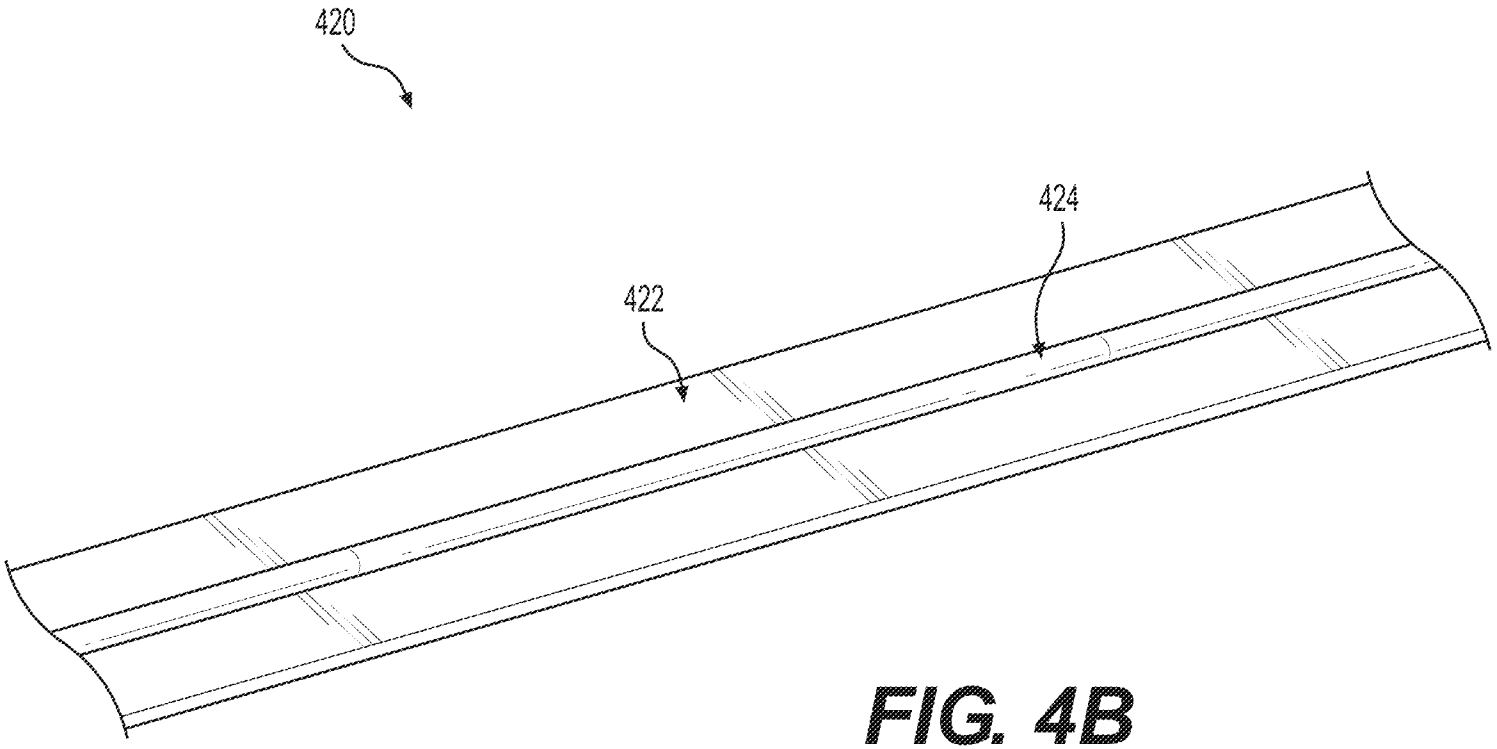
FIG. 4B depicts aspects of a securing layer, according to embodiments of the present invention.

FIG. 4B shows a securing layer 420 according to embodiments of the present invention. As depicted here, securing layer 420 includes a backing 422 and a gripping element 424. The backing 422 can be an elastic band. In the illustrated embodiment, there is one elongate linear gripping element. In some cases, gripping element 424 extends or projects from the surface of the backing 422.

Figure 4C:
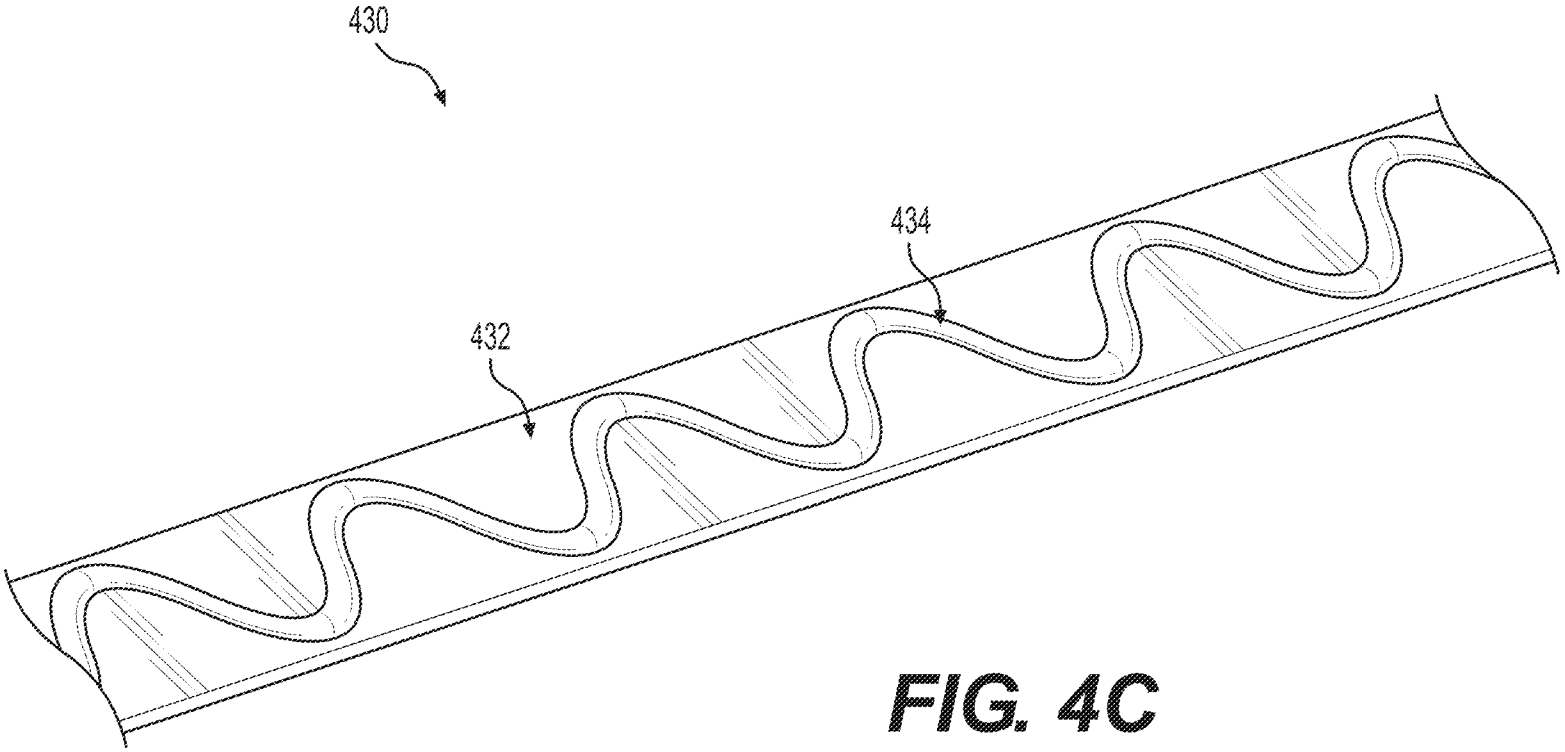
FIG. 4C depicts aspects of a securing layer, according to embodiments of the present invention.

FIG. 4C shows a securing layer 430 according to embodiments of the present invention. As depicted here, securing layer 430 includes a backing 432 and one or more gripping elements 434. The backing 432 can be an elastic band. In the illustrated embodiment, there is one elongate sine curve gripping element. In some cases, gripping element 434 extends or projects from the surface of the backing 432.

Figure 4D:
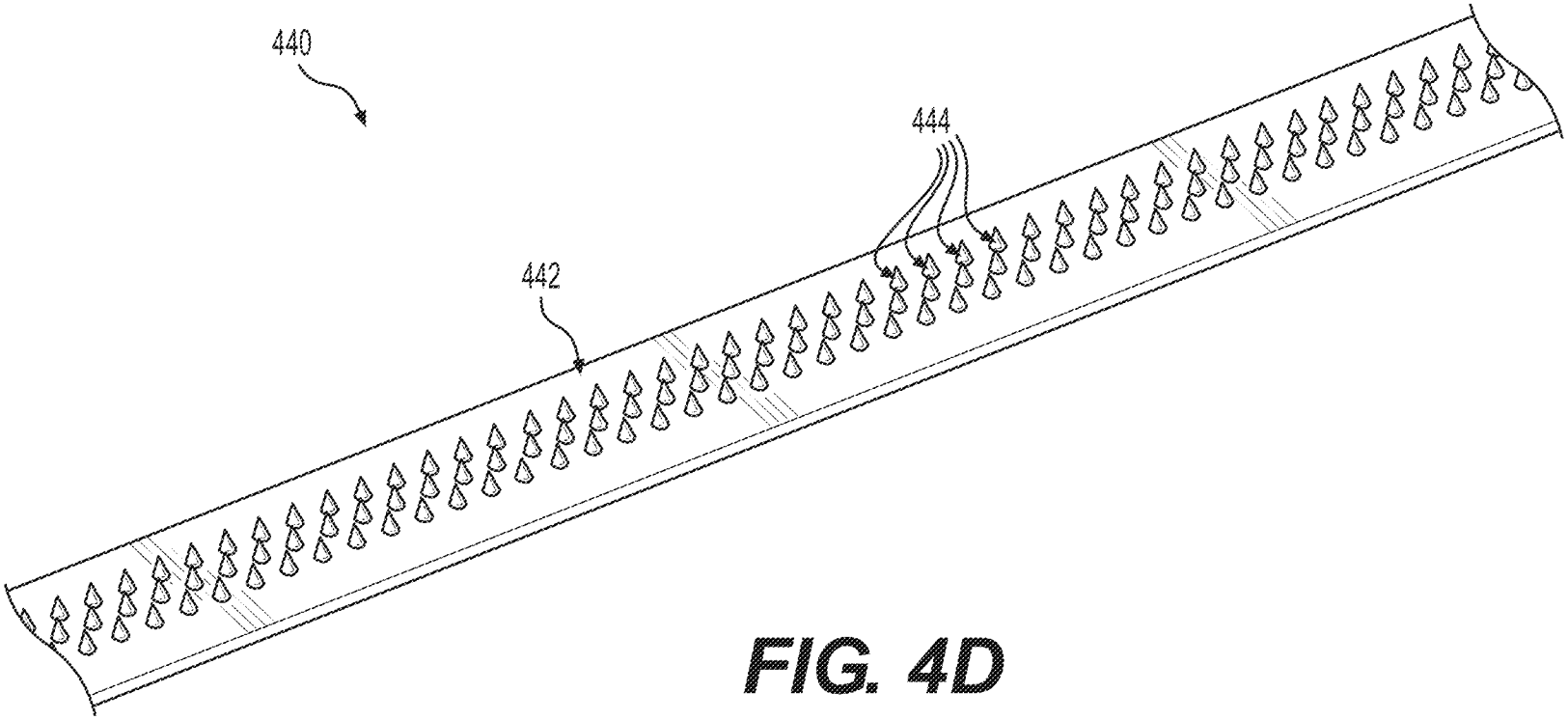
FIG. 4D depicts aspects of a securing layer, according to embodiments of the present invention.

FIG. 4D shows a securing layer 440 according to embodiments of the present invention. As depicted here, securing layer 440 includes a backing 442 and one or more gripping elements 444. The backing 442 can be an elastic band. In some cases, gripping elements 444 extend or project from the surface of the backing 442.

Figure 5:
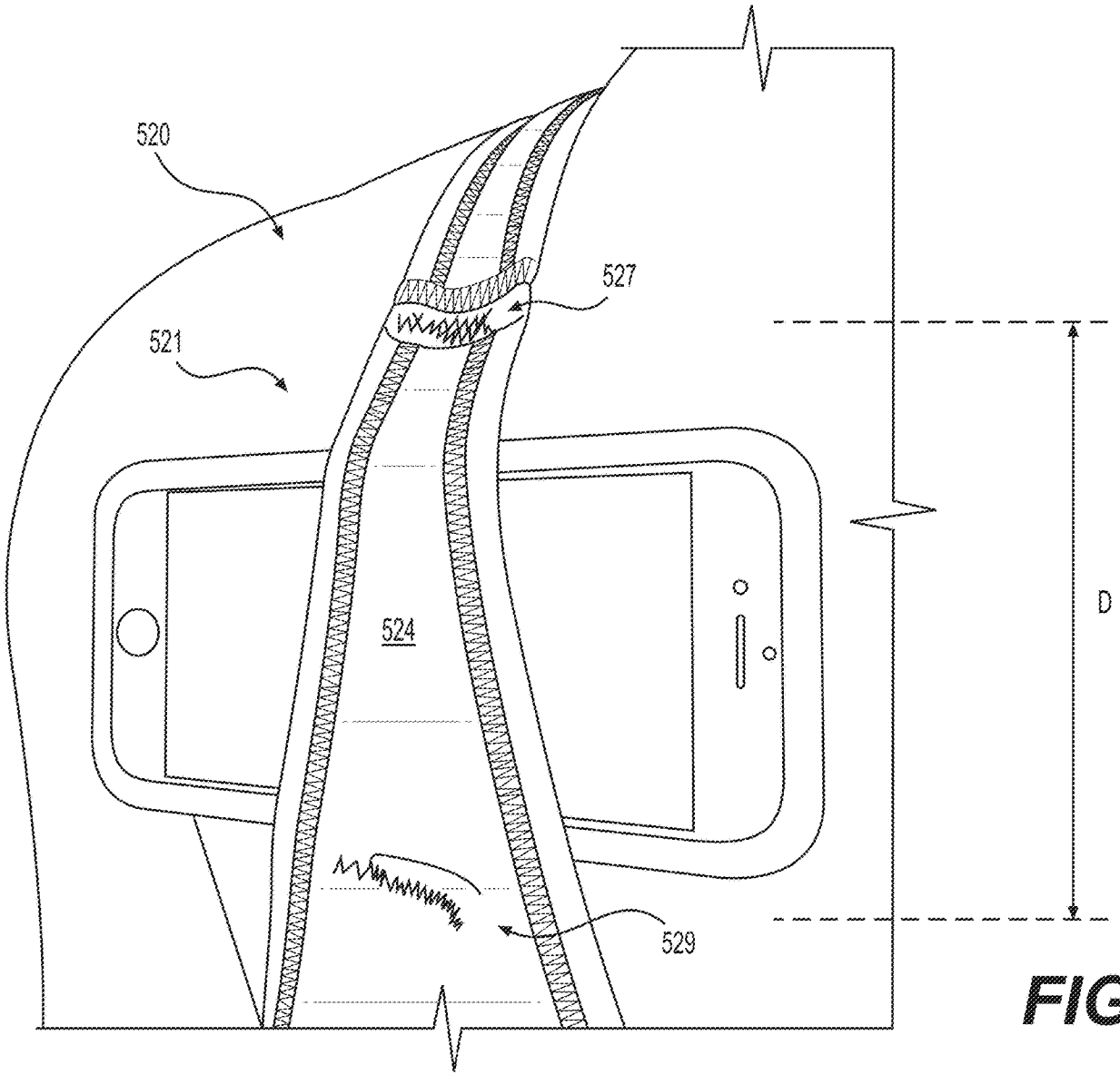
FIG. 5 depicts aspects of a utility bra, according to embodiments of the present invention.

According to some embodiments, for example as depicted in FIG. 5, a strap 520 can include an upper stitching line 527 and a lower stitching line 529. Upper stitching line 527 operates to secure an upper portion of the outer securing layer 524 with an upper portion of the inner securing layer (not shown). Similarly, lower stitching line 529 operates to secure a lower portion of the outer securing layer 524 with a lower portion of the inner securing layer (not shown). As illustrated in FIG. 5, a strap securing mechanism 521 can be disposed on the front side of strap 520. Upper stitching line 527 and lower stitching line 529 can be separated by a distance D, and the value of the distance can be selected so as to accommodate any particular persona item. For example, a wider spacing D (e.g. 4 inches) between the stitching lines 527, 529 can be used for holding large phones, and a narrower spacing D (e.g. 1.5 inches) between the stitching lines 527, 529 can be used for holding smaller phones. Hence, in some instances, D may have a value within a range from 1.5 inches to 4 inches. In some cases, D may have a value within a range from 0.5 inches to 9 inches.

Figure 5A:
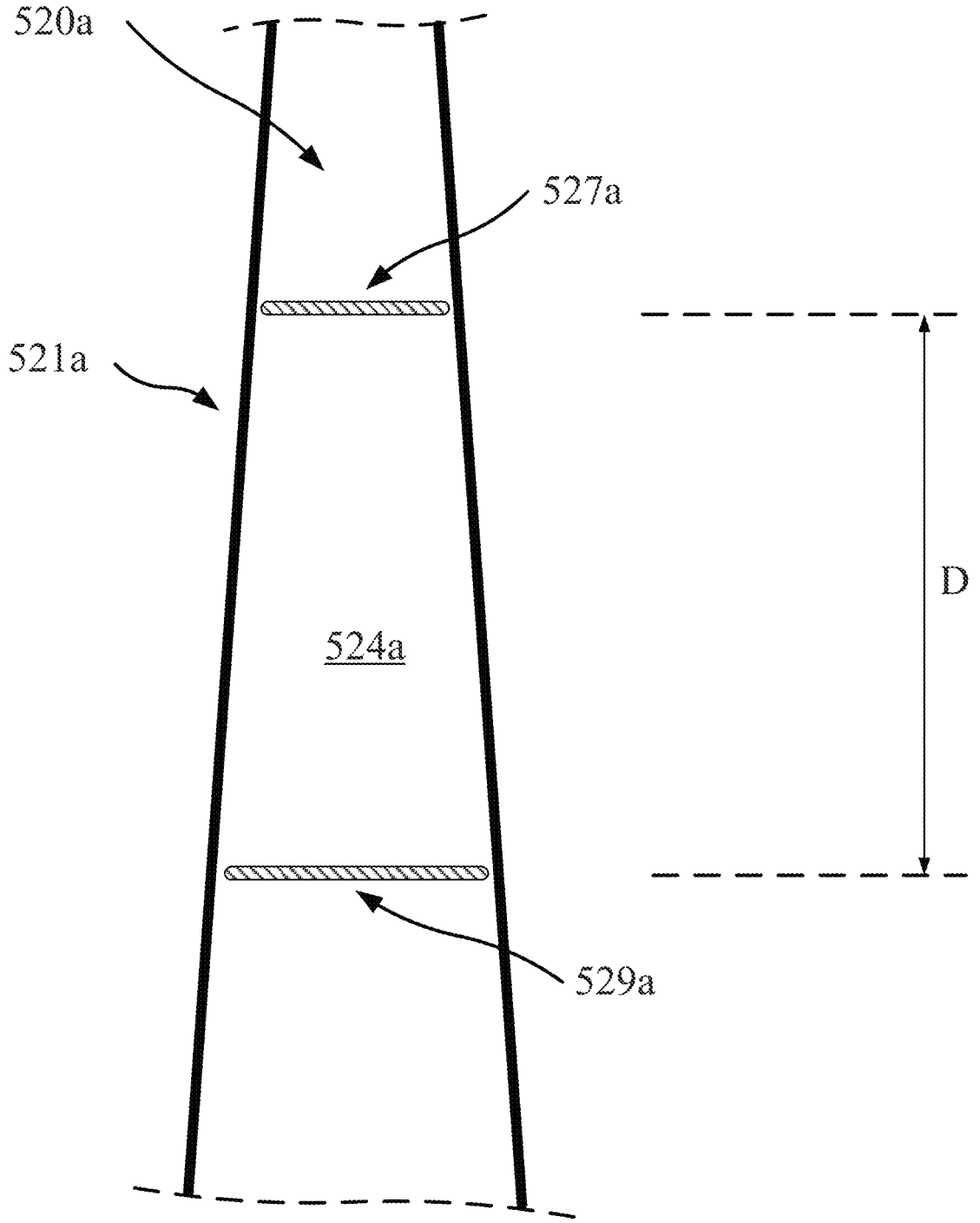
FIG. 5A depicts aspects of a utility bra, according to embodiments of the present invention.
Figure 6:
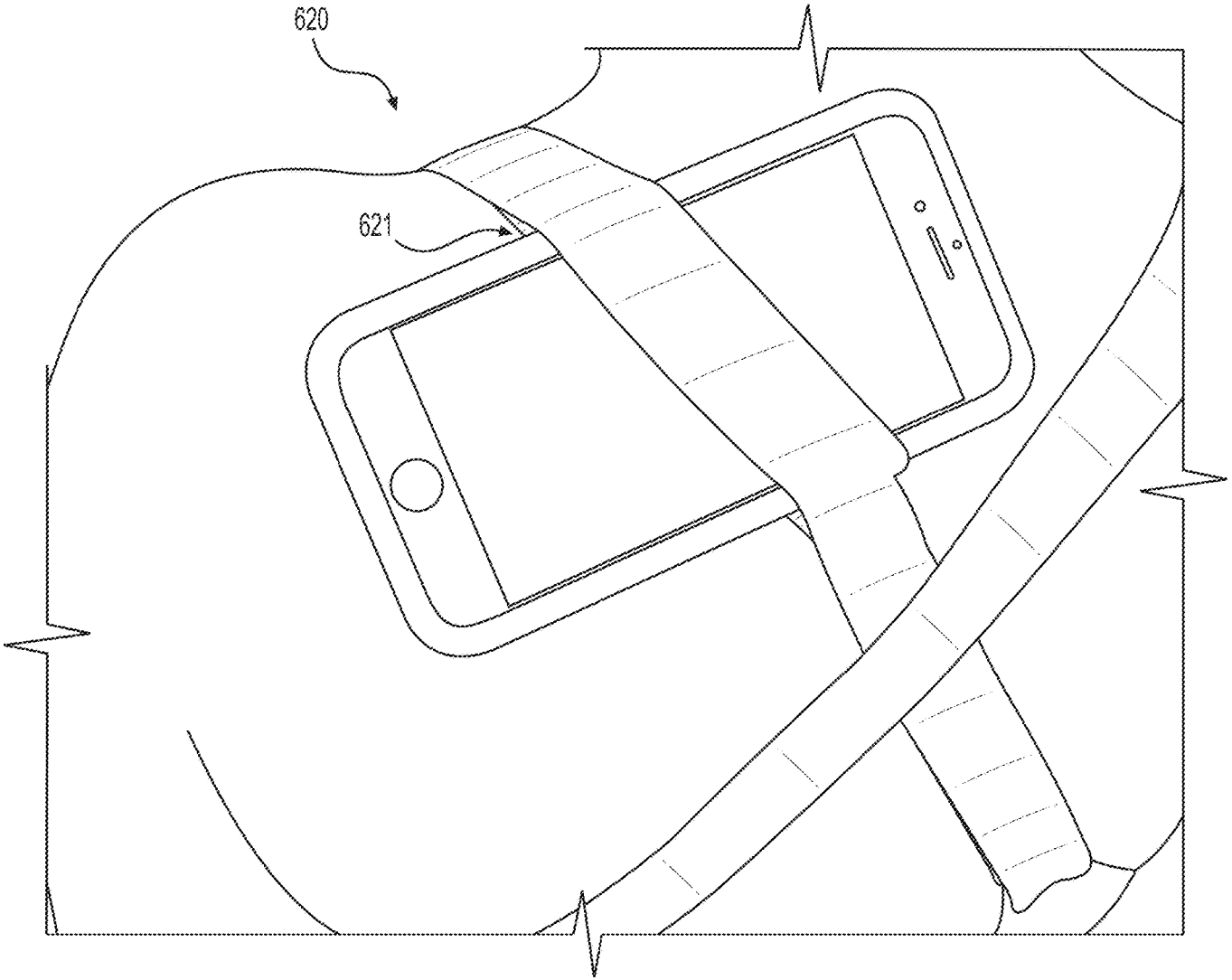
FIG. 6 depicts aspects of a utility bra, according to embodiments of the present invention.

According to some embodiments, for example as depicted in FIG. 5A, a strap 520*a* can include an upper stitching line 527*a* and a lower stitching line 529*a*. Upper stitching line 527*a* operates to secure an upper portion of the outer securing layer 524*a* with an upper portion of the inner securing layer (not shown). Similarly, lower stitching line 529*a* operates to secure a lower portion of the outer securing layer 524*a* with a lower portion of the inner securing layer (not shown). As illustrated in FIG. 5A, a strap securing mechanism 521*a* can be disposed on the front side of strap 520*a*. Upper stitching line 527*a* and lower stitching line 529*a* can be separated by a distance D, and the value of the distance can be selected so as to accommodate any particular persona item. For example, a wider spacing D (e.g. 4 inches) between the stitching lines 527*a*, 529*a* can be used for holding large phones, and a narrower spacing D (e.g. 1.5 inches) between the stitching lines 527*a*, 529*a* can be used for holding smaller phones. Hence, in some instances, D may have a value within a range from 1.5 inches to 4 inches. In some cases, D may have a value within a range from 0.5 inches to 9 inches. As shown here, stitching lines 527*a*, 529*a* can be parallel with one another. In other embodiments, for example as depicted in FIG. 6, a strap securing mechanism 621 can be disposed on the back side of strap 620.

Figure 7:
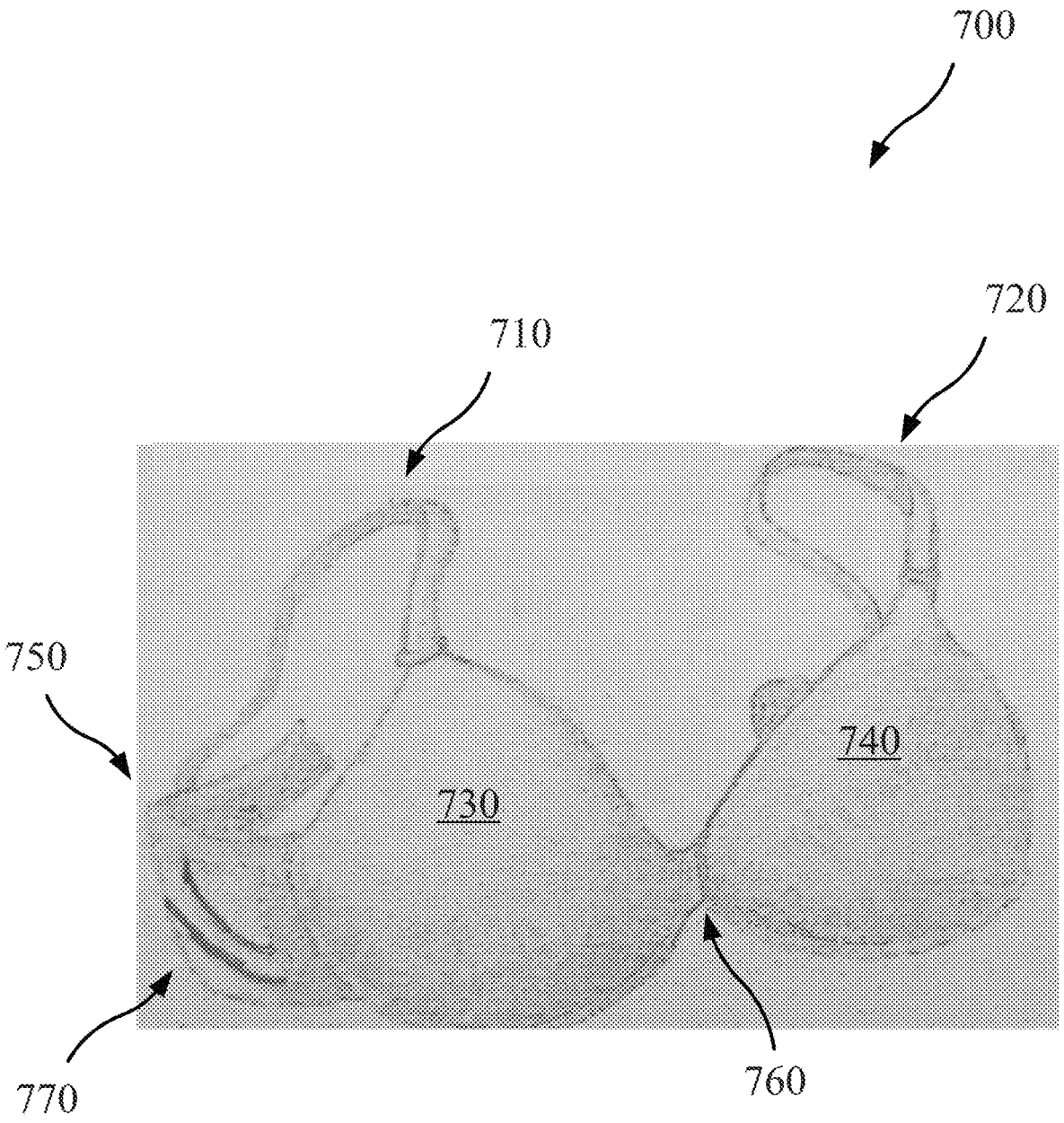
FIG. 7 depicts aspects of a utility bra, according to embodiments of the present invention.

FIG. 7 depicts aspects of an exemplary bra 700. As illustrated here, bra 700 includes a right strap 710, a left strap 720, a right cup 730, a left cup 740, a right wing 750, a left wing (not shown), and a center panel 760. The right wing 750 includes a right wing pocket 770.

Figure 8:
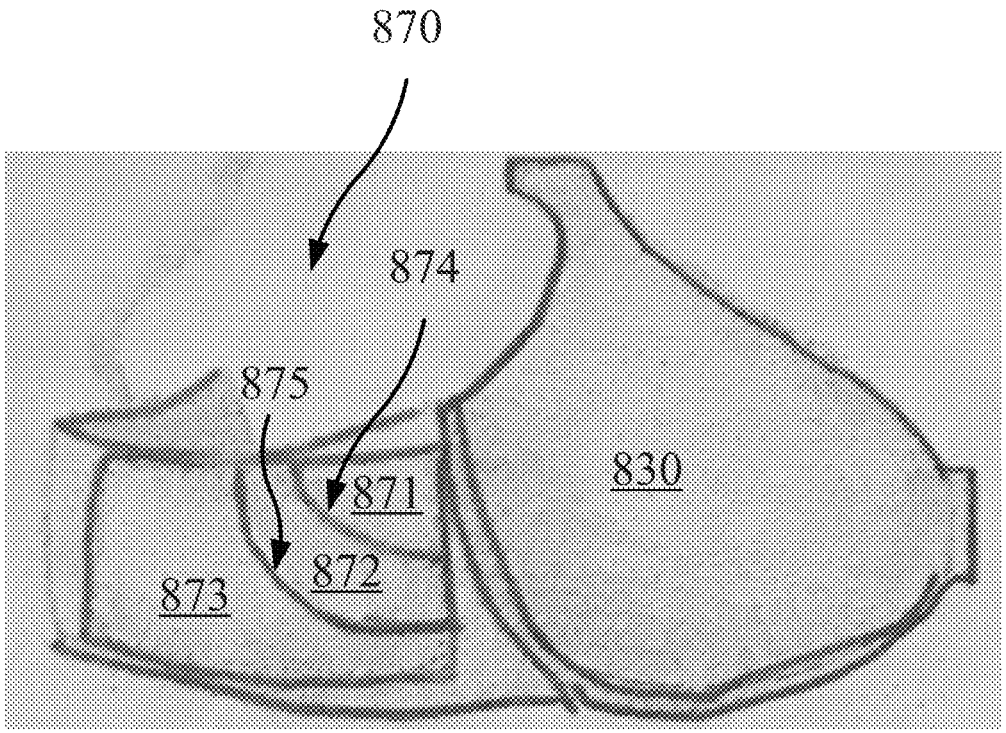
FIG. 8 depicts aspects of a utility bra, according to embodiments of the present invention.

As illustrated in the embodiment shown in FIG. 8, a right wing pocket 870 can include an inner pocket liner 871, an intermediate pocket liner 872, and an outer pocket liner 873. An inner pocket bag 874 is disposed between inner pocket liner 871 and intermediate pocket liner 872. An outer pocket bag 875 is disposed between intermediate pocket liner 872 and outer pocket liner. Right wing pocket 870 is located posterior to the right cup 830.

Figure 9:
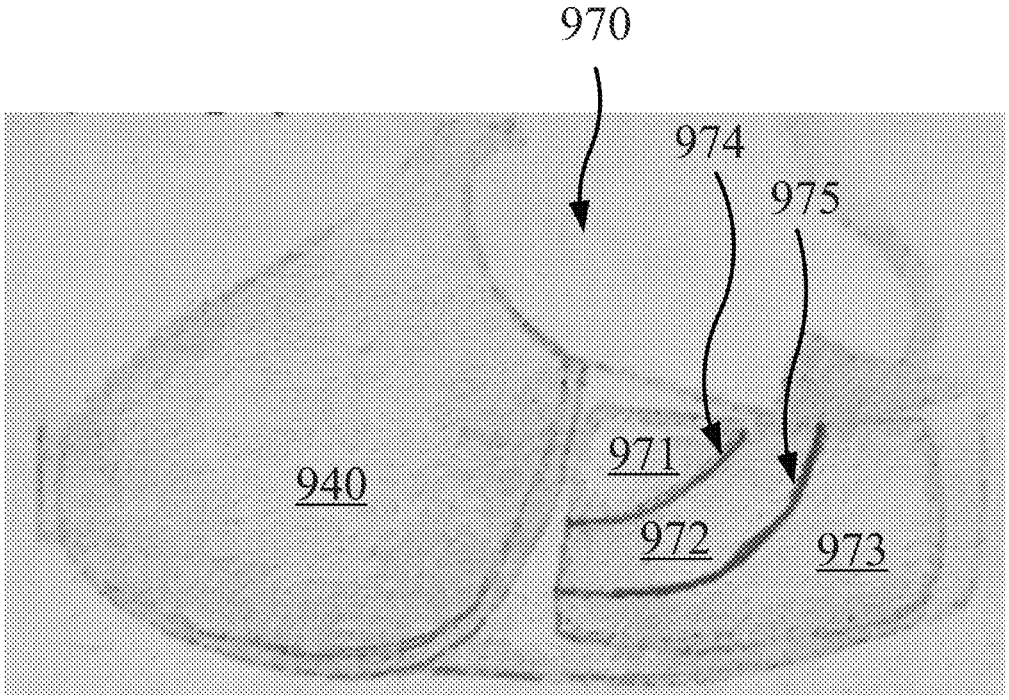
FIG. 9 depicts aspects of a utility bra, according to embodiments of the present invention.

As illustrated in the embodiment shown in FIG. 9, a left wing pocket 970 can include an inner pocket liner 971, an intermediate pocket liner 972, and an outer pocket liner 973. An inner pocket bag 974 is disposed between inner pocket liner 971 and intermediate pocket liner 972. An outer pocket bag 975 is disposed between intermediate pocket liner 972 and outer pocket liner. Left wing pocket 970 is located posterior to the left cup 940. Inner pocket bag 974 and/or outer pocket bag 975 can be used to carry or hold items such as identification cards, credit cards, cash, and the like. In some cases, a pocket can include an additional interior lining or padding to help create an additional layer between the person wearing the bra and the items contained in the pockets.

Wing pockets such as right wing pocket 870 and/or left wing pocket 970 can be embodied by any of a variety of pocket styles, including for example patch pockets, flap pockets, slit pockets, welt pockets, stand pockets, and the like.

Figure 10:
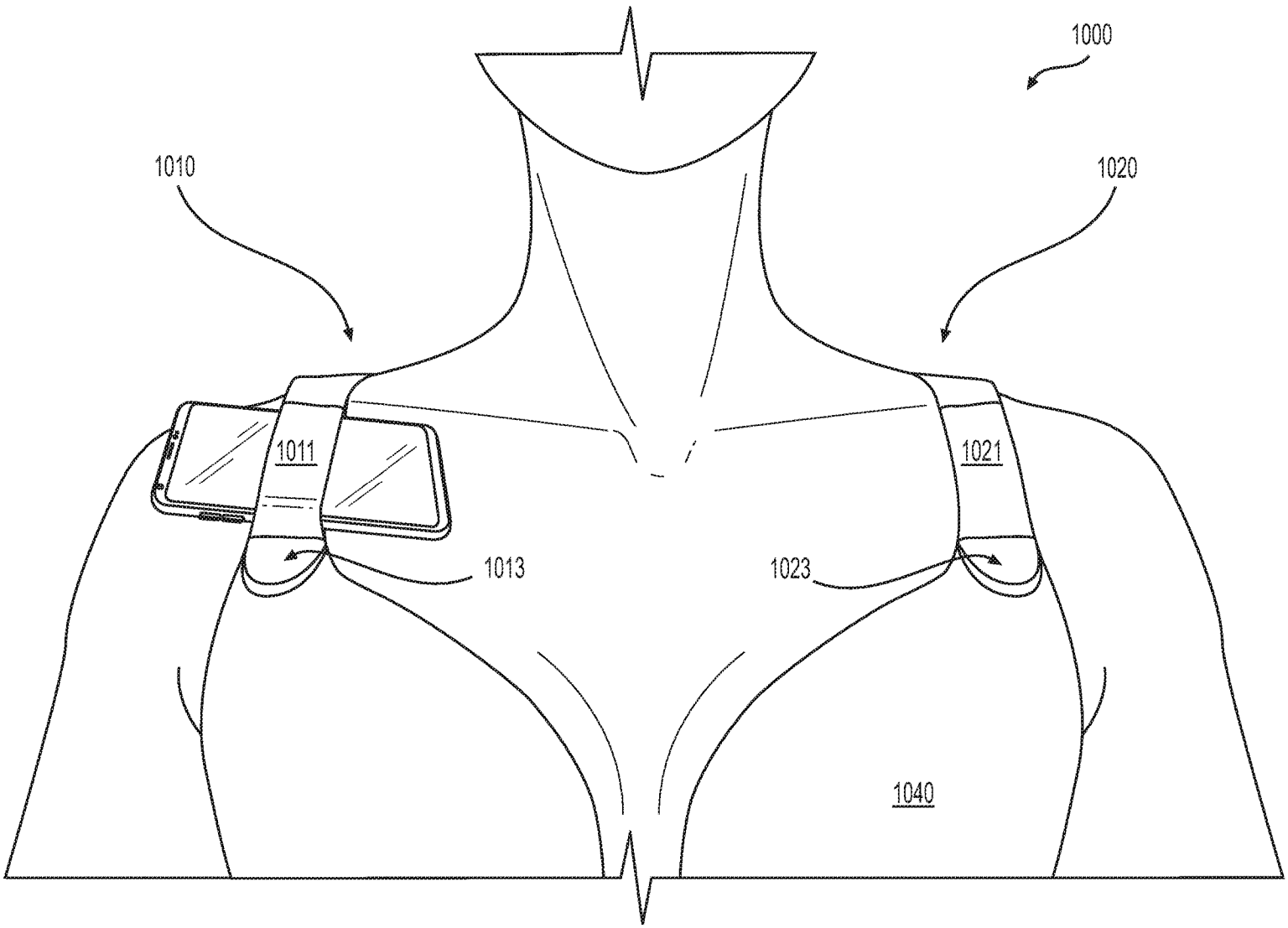
FIG. 10 depicts aspects of a utility bra, according to embodiments of the present invention.

FIG. 10 depicts aspects of an exemplary bra 1000. Bra 1000 also includes a right strap securing mechanism 1011 and a left strap securing mechanism 1021. Right strap 1010 further includes or is coupled with a right strap attachment mechanism 1013, which is in the form of a loop. Left strap 1020 further includes or is coupled with a left strap attachment mechanism 1023, which is in the form of a loop.

Attachment mechanisms 1013, 1023 can be constructed of a stretchy bungee or flexible material, and can be coupled to the strap at the base of the strap, on the front side of the bra. In some cases, attachments mechanisms 1013, 1023 can be present in the form of a loop. In some cases, attachments mechanisms 1013, 1023 can be used to hold a J-hoop or carabineer that enable the person wearing the bra to carry keys, mace/pepper spray, or other similar protection items.

All features of the described systems and/or devices are applicable to the described methods mutatis mutandis, and vice versa. All patent filings, scientific journals, books, treatises, and other publications and materials discussed in this application are hereby incorporated by reference for all purposes. A variety of modifications are possible within the scope of the present invention. A variety of parameters, variables, factors, and the like can be incorporated into the exemplary method steps or system components. While the specific embodiments have been described in some detail, by way of example and for clarity of understanding, a variety of adaptations, changes, and modifications will be obvious to those of skill in the art.

Where a range of values is provided, it is understood that each intervening value between the upper and lower limits of that range is also specifically disclosed, to the smallest fraction of the unit or value of the lower limit, unless the context clearly dictates otherwise. Any encompassed range between any stated value or intervening value in a stated range and any other stated or intervening value in that stated range is disclosed. The upper and lower limits of those smaller ranges may independently be included or excluded in the range, and each range where either, neither, or both limits are included in the smaller range is also disclosed and encompassed within the technology, subject to any specifically excluded limit, value, or encompassed range in the stated range. Where the stated range includes one or both of the limits, ranges excluding either or both of those included limits are also included.

While the above provides a full and complete disclosure of exemplary embodiments of the present invention, various modifications, alternate constructions and equivalents may be employed as desired. Consequently, although the embodiments have been described in some detail, by way of example and for clarity of understanding, a variety of modifications, changes, and adaptations will be obvious to those of skill in the art. Accordingly, the above description and illustrations should not be construed as limiting the invention, which can be defined by the claims.

What is claimed is:

1. A utility bra, comprising:

a right strap;

a left strap;

a right cup coupled with the right strap;

a left cup coupled with the left strap;

a center panel coupled with the right cup and the left cup; and a strap securing mechanism having an inner securing layer and an outer securing layer, the inner securing layer comprising an inner gripping element and the outer securing layer comprising an outer gripping element, the inner gripping element and the outer gripping element facing toward one another when the utility bra is worn by a user, wherein the strap securing mechanism is coupled with the right strap or the left strap or both, and wherein the inner gripping element and the outer gripping element operate to grip a personal item between the inner securing layer and the outer securing layer.

2. The utility bra according to claim 1, wherein the inner gripping element comprises a non-slip material.

3. The utility bra according to claim 1, wherein the inner gripping element comprises a material selected from the group consisting of a rubber, a thermoplastic, a silicone, and a polyurethane.

4. The utility bra according to claim 1, wherein the strap securing mechanism is a first strap securing mechanism, the utility bra comprising a second strap securing mechanism, the second strap securing mechanism having an inner securing layer and an outer securing layer, the inner securing layer of the second strap securing mechanism comprising an inner gripping element and the outer securing layer comprising an outer gripping element, the inner gripping element and the outer gripping element facing toward one another when the utility bra is worn by a user, and wherein the inner gripping element and the outer gripping element are configured to grip a personal item between the inner securing layer and the outer securing layer.

5. The utility bra according to claim 1, wherein the strap securing mechanism is coupled with the right strap.

6. The utility bra according to claim 1, wherein the strap securing mechanism is coupled with the left strap.

* * * * *